US007730944B2

(12) United States Patent
Abdelmalek et al.

(10) Patent No.: US 7,730,944 B2
(45) Date of Patent: Jun. 8, 2010

(54) MULTI-FUNCTION COMPLETION TOOL

(76) Inventors: Adel Ghobrial Abdelmalek, 1443 Prospect Blvd., Houma, LA (US) 70364; Keith Fry, 1443 Prospect Blvd., Houma, LA (US) 70364; Mohammad Amir Malek, 1443 Prospect Blvd., Houma, LA (US) 70364; Jose Melendez, 1443 Prospect Blvd., Houma, LA (US) 70364

( * ) Notice: Subject to any disclaimer, the term of this patent is extended or adjusted under 35 U.S.C. 154(b) by 223 days.

(21) Appl. No.: 11/933,242

(22) Filed: Oct. 31, 2007

(65) Prior Publication Data

US 2009/0107668 A1 Apr. 30, 2009

(51) Int. Cl.
*E21B 49/00* (2006.01)

(52) U.S. Cl. ..... 166/250.17; 166/332.4

(58) Field of Classification Search ..... 166/250.17, 166/332.4, 332.6, 313
See application file for complete search history.

(56) References Cited

U.S. PATENT DOCUMENTS 5,641,023 A * 6/1997 Ross et al. ..... 166/386
7,377,321 B2 * 5/2008 Rytlewski ..... 166/313
7,472,750 B2 * 1/2009 Walker et al. ..... 166/278
2008/0236842 A1 * 10/2008 Bhavsar et al. ..... 166/381

* cited by examiner

*Primary Examiner*—William P Neuder
(74) *Attorney, Agent, or Firm*—Ahab S. Ayoub

(57) ABSTRACT

A multi-functional completion tool which may be lowered into a wellbore coupled to a length of tubing, and then utilized to test various lengths of the tubing at pressure. The tool may also function as a positive plug and may also be used to set the packer, and is also useable as a tubing self-filling tool. Various retention elements are disposed within the tool and configured to release at predetermined pressures, or within predetermined ranges of pressure, thereby transforming the tool from a first configuration to a second configuration depending on the desired function. The tool may also contain a pressure-regulating assembly for regulating the differential pressure across the assembly. The tool may also include an indicator assembly for confirming that the tool has entered a plugging configuration, typically by altering a pressure within the tubing, such alteration being detectible at a surface location.

20 Claims, 5 Drawing Sheets

MULTI-FUNCTION COMPLETION TOOL

BACKGROUND OF INVENTION

1. Field of the Invention

The present invention relates generally to a downhole oil and gas well completion tool which is operatively connectible to a lower section of tubing or a packer and configured to perform multiple completion-related functions.

2. Background Art

The harvesting of hydrocarbons from a subterranean formation involves the deployment of a drilling tool into the earth. The drilling tool is driven into the earth from a drilling rig to create a wellbore through which hydrocarbons are passed. Once a predetermined well depth is reached, the formation is tested to evaluate and determine whether the well will be completed for production, or plugged and abandoned.

Completion of a well generally refers to the operations that prepare a well bore for producing oil or gas from the reservoir. The goal of these operations is to optimize the flow of the reservoir fluids into the well bore, up through the producing string, and into the surface collection system.

The well bore is typically lined (cased) with steel pipe, and the annulus between well bore and casing is filled with cement. Properly designed and cemented casing prevents collapse of the well bore and protects fresh-water aquifers above the oil and gas reservoirs from becoming contaminated with oil and gas and the oil reservoir brine. Similarly, the oil and gas reservoir is prevented from becoming invaded by extraneous water from aquifers that were penetrated above or below the productive reservoir.

The nature of the reservoir, evaluated from a core analysis, cuttings, or logs, or from experience with similar productive formations, determines the type of completion to be used. In a barefoot completion, the casing is set just above the producing formation, and the latter is drilled out and produced with no pipe set across it. Such a completion can be used for hard rock formations which are not friable and will not slough, and when there are no opportunities for producing from another, lower reservoir. Set-through and perforated completions are also employed for relatively well-consolidated formations from which the potential for sand production is small. However, the perforated completion is used when a long producing interval must be prevented from collapse, when multiple intervals are to be completed in the one borehole, or when intervening water sands within the oil-producing interval are to be shut off and the oil-saturated intervals selectively perforated.

A string of steel tubing is lowered into the casing string and serves as the conduit for the produced fluids. The tubing may be hung from the well-head or supported by a packer set above the producing zone. The packer is used when it is desirable to isolate the casing string from the produced fluids because of the latter's pressure, temperature, or corrosivity, or when such isolation may improve production characteristics. The string, which may be referred to herein as a tubing string, may comprise any number of components known in the art. Such components, in addition to tubulars, may include tools, joints, packers, etc.

To complete the well, casing is installed and cemented in the wellbore, then production tubing is installed in the casing, which is perforated so that hydrocarbons may pass from the formation into the wellbore, and up to the tubing string to the surface for collection. Often a series of tests are conducted as a part of this process, to confirm the integrity of the casing and tubing.

When carrying out testing or other operations in a wellbore, test equipment or other apparatus may be mounted on an end portion of a string of tubular sections, known as tubulars to form a tubing string. The equipment is lowered into the bore on the end of the string, the length of the string being increased by the addition of further tubulars, which are threaded together to define a continuous internal bore between the apparatus and the surface.

A number of traditional methods exist for testing completion of a well and tubing.

The most commonly used method involves the use of a wire-line retrievable plug. This process typically involves the hiring of a wire-line contractor to both run and pull the plug. The overall process is time-consuming, typically taking about 3-4 hours to set up the wire-line unit, and lower and set the plug by the wire-line. After setting the hydraulic packer and testing the completion and tubing, the wire-line operator will run the wire-line into the tubing again to retrieve the plug which might consume another 3-4 hours if no delays are encountered. Debris and impurities in the completion fluid and/or pressure trapped around the plug often result in sticking of the plug in the well. Retrieving a stuck plug can greatly increase the length of the process and may also lead to a loss of wire-line in the well, which will require the hiring of additional specialists to perform a fishing operation.

The use of the above-mentioned wire-line operation is typically feasible only if the well deviation is no greater than 70 degrees. If the testing location where the plug will need to be set is at a greater deviation, the wire-line method may not be practical and the operator must use another method of running the plug such as coiled tubing. A coiled tubing operation, once on location, takes about 5 hours to set up. Once all of the equipment is set up, running the plug by means of the coiled tubing can easily take at least 4 hours, depending on depth. The coiled tubing operation may easily cost tens of thousands of dollars in addition to the total time used to run and retrieve the plug which may exceed 10 hours, if no problems are encountered.

A more recently developed method for setting a hydraulic packer and testing the completion and tubing involves the use of a glass disc which is run inside a special pipe attached to the bottom of the tubing string. When using the glass disc method, the tubing cannot be self filled, which will require that the completions operator either manually fill the tubing via a water hose from the surface, requiring significant time, or the operator will need to add another piece of equipment to the tubing string known as a self-filling tool.

After setting the packer and testing the tubing the completions operator needs to break the glass disc in order to have the tubing opened and ready for production. If the well is not highly deviated, the wire line contractor can set up his equipment and run into the well with his tool string and break the glass disc. This operation will take around 4-5 hours.

If the well is highly deviated (more than 70 degrees) then the completions operator may need to use a coil tubing contractor to break the glass disc. Also this operation will take around 5 to 6 hours in addition to the coil tubing set up/rental cost.

Another method of setting the packer and testing the tubing is to use a pump out plug which is a special short pipe with a ball seat fixed in a seat with a number of shear screws. After running the tubing completely, a ball is dropped from the surface. It takes around 40-60 minutes until the ball seats on the ball seat, then surface pressure is applied against the ball to set the packer and test the tubing. After testing the tubing the surface pressure is increased to shear the ball seat shear screws and pump the seat and the ball down into the well bottom. This method holds pressure from above only and can not hold pressure from below. For this reason another plug/barrier is needed to be run at the bottom of the tubing while dismantling the rig blow out preventor (BOP) and mounting the Christmas tree. Also some problems can happen when shearing the shear screws of the pump out plug due to completion fluid pressure differential across the ball, that leads to inaccurate shear value (either more or less than the predetermined pressure for shearing).

Accordingly, a need exists for a tool capable of performing various completion-related operations without requiring repeated pulling of the tool, or hiring of one or more specialists.

SUMMARY OF INVENTION

A downhole tool is disclosed that comprises a housing having a sleeve moveably disposed therein, a plug, a peripheral annulus and a lower retention assembly, collectively configured to provide multiple capabilities when used with a tubing string. Such capabilities may include, but are not limited to, self-filling of the string, testing of the string at one or more pressures, and formation of a positive plug. Once various operations are completed, the plug may be released from the tool, thereby allowing relatively unrestricted flow through the tool when the well is in production mode. An indicator assembly may also be disposed within the tool, to indicate to a surface location that the tool has entered a positive plugging configuration.

A method for testing a tubing string is disclosed, including the provision of a multi-functional testing tool, operative connection of the tool to a tubing string, lowering of the tool to a first test depth at which a first test is conducted, and then depending upon one or more parameters, the tool may be used for testing at a second depth, for formation of a positive plug, and/or configured to allow flow through a well.

A method for manufacturing a downhole tool is disclosed, including disposing a sleeve within a housing, the sleeve having a plug operatively connected to one end, and disposing a lower retention assembly within the housing, beneath the sleeve. The lower retention assembly will typically comprise a cap operatively connected to a seat. Retention elements may be used to operatively connect the plug and sleeve, and to operatively connect a pressure ring to the housing.

Other aspects and advantages of the invention will be apparent from the following description and the appended claims.

DETAILED DESCRIPTION

Figure 1:
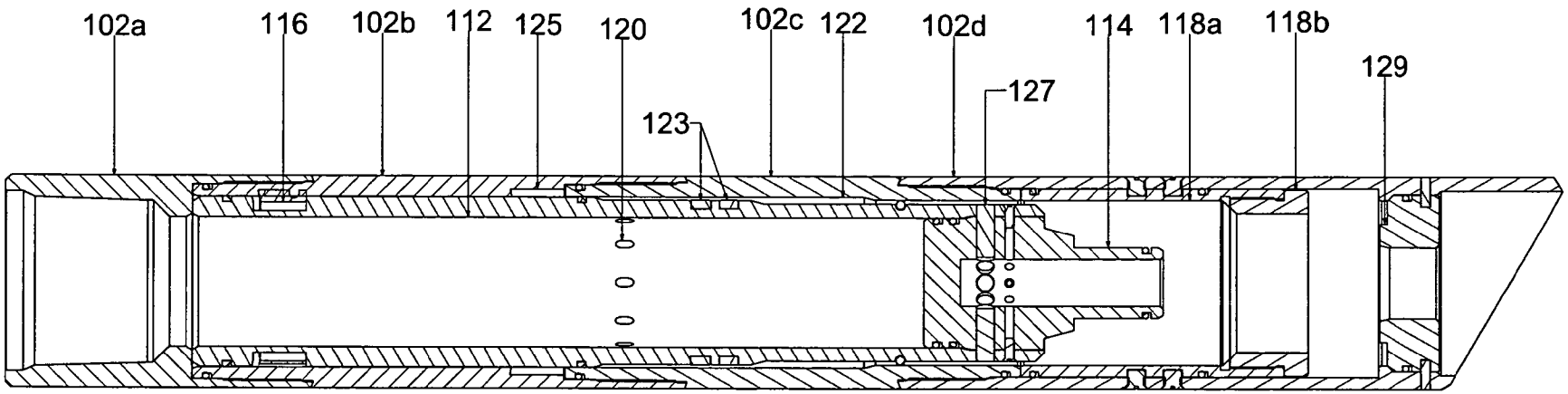
FIG. 1 shows one embodiment of the invention in a running (floating) configuration.

As shown in FIG. 1, one embodiment of the invention comprises a downhole tool 100 configured to perform multiple completion-related tasks, which may include, but are not limited to, self-filling of tubing, setting of a packer, testing of the tubing, testing of the annulus, and/or formation of a positive plug. The tool 100 comprises a housing 102. The housing 102 may be formed as a single unitary structure, or may include any number of sub-housings. In the embodiment of FIG. 1, the housing 102 comprises multiple operatively-connected sub-housings 102*a*, 102*b*, 102*c*, 102*d*. The housing 102 will typically have a cylindrical shape, although any other shape capable of passing through a wellbore may also be used.

An upper end of the housing 102 (or the sub-housing 102*a*) is configured to connect to a tubular or other component of a string leading to a surface location. Such configuration may include threads, shoulders and any other components known in the art to exist in the interface between two adjoining components of a tubing string.

While the tool 100 will typically be disposed at a lower end of a string, and often may comprise the lower-most component of the string, the tool 100 may be disposed anywhere along the string. Accordingly, embodiments of the tool 100 may also be threaded or otherwise configured at a lower end to connect to other components of the string. In the embodiment of FIG. 1, the second end of the tool 100 is configured as a wireline re-entry guide (mule shoe).

As used herein, the terms "lower," "bottom," or "bottom sub" refer to that section or end of the tool 100 which will be oriented closer to the end of the string (or nearer the bottom-hole), while the terms "upper," "top," or "top sub" refer to that section or end of the tool 100 which will be located closer to that portion of the string leading to a surface location. Thus, in a vertical wellbore, the "top" or "top sub" section of the tool 100 will be above the "bottom" or "bottom sub" section of the tool 100 when the tool 100 is operatively connected to a string suspended in the wellbore. Similarly, the terms "upper" and "lower" refer to relative locations as determined within a vertical wellbore.

A number of components are disposed within the housing 102, including a sleeve 112, a plug 114, and a sleeve locking element 116. The sleeve 112 is moveable within a first range defined at an upper end by an upper sleeve retention element 126, and at a lower end by a first position of a lower retention assembly 118. In the embodiment of FIG. 1, the upper sleeve retention element 126 is fixed (in contrast to releasable retention elements, as will be described below) and comprises a shoulder or similar internal configuration within the housing 102 and the lower retention assembly 118 comprises a seat 118*a* operatively connected to a cap 118*b*. The lower retention assembly 118 is moveable from a first position to a second position once a predetermined pressure is applied from above. The first range of movement of the sleeve 112 encompasses a running configuration and a testing configuration of the tool 100. Additional configurations, as will be described in detail below, will typically include a plugging configuration, and a production configuration.

In the running configuration shown in the embodiment of FIG. 1, space between the cap 118*b* and the sleeve 112 and/or plug 114 is created by upward displacement of the sleeve 112 due to force exerted on the plug 114 from beneath as the tool 100 is run into the wellbore. This space permits fluid to flow into the bottom of the housing 102, around the plug 114, through the peripheral annulus 122, through one or more openings 120, and into the sleeve 112, which is in fluid communication with the tubing above the tool 100 and therefore permits passage of fluid from a location below the tool 100, into the tubing above the tool 100. Such a configuration advantageously allows for the filling of tubing above the tool 100 without the need for manual filling from the surface, or the addition of additional fill tools. Such a configuration also advantageously facilitates the downward movement of the tool 100, and operatively connected tubing, through the wellbore with decreased resistance from the fluid beneath, which is able to pass through the tool 100.

The force exerted on the plug 114 from beneath typically comprises a fluid bottom-hole pressure acting in an upward direction as the tool 100 is moved downward through the wellbore. This "buoyancy force" is generated by the well's fluid hydrostatic head pressure. As the tool 100 is lowered into a wellbore, the buoyancy force acts upon the lower surface(s) of the plug 114, causing the operatively-connected sleeve 112 to move upwards within the housing 102, and aligning the openings 120 of the sleeve 112 with the peripheral annulus 122 of the tool 100, thus allowing the fluids to pass through openings 120 in the sleeve 112 and exit through the top of the housing 102.

As used herein, the term "retention element" means any element configured to retain a component in a desired position or range of movement under predetermined conditions. Embodiments of retention elements may be configured to release an operatively connected component under predetermined conditions. Such embodiments may include, but are not limited to, shear screws, shear pins, ball-and-socket configurations, and any other elements capable of performing similar functions. Alternatively, other embodiments of retention elements may be fixed, and configured to permanently retain an operatively connected component within a predetermined location or range under normal use of the tool 100, e.g, an internal shoulder 126 of the housing 102. Releasable retention elements typically maintain a desired relative orientation of operatively connected components under a first set of conditions (e.g., within a certain hydraulic pressure range) and release such component under a second set of conditions (e.g., beyond a certain hydraulic pressure range).

In other embodiments, retention elements may be positioned/configured to allow a certain movement, or relative freedom of movement until certain conditions are met. For example, the retention element may lock into a position under specific conditions, thereby fixing an operatively connected component in space relative to a second component which is configured to receive a portion of the retention element under specific conditions. As will be described in detail below, the sleeve locking element 116 of FIG. 1 is an example of such a retention element. While the embodiment of FIG. 1 shows the sleeve locking element 116 operatively connected to the sleeve 112, and a mating recess 125 disposed within the housing 102, other embodiments may include a recess 125 disposed in the sleeve 112, and a sleeve locking element 116 operatively connected to the housing 102.

Once a first test depth is reached in a wellbore, running of the tool 100 is discontinued, and surface pressure is increased in the tubing above the tool 100 to a pressure sufficient to overcome any buoyancy force acting on the plug 114 from beneath, thereby maintaining the sleeve 112 at the lower end of its first range of movement. Typically, the increase of surface pressure is achieved using a rig pump to increase pressure in the tubing, adding to the existing pressure exerted by the weight of the completion fluid above the tool 100. As shown in embodiment of FIG. 2, the tool 200 is now in a testing configuration. Increased pressure in the tubing above the tool 200 exerts a downward force on the plug 214, thereby maintaining the operatively connected sleeve 212 at the lower end of its first range of movement.

In the testing configuration, the lower surface(s) of the sleeve 212 will be in contact with the upper surface(s) of the cap 218*b* of the lower retention assembly 218 and/or a seal 217 operatively connected thereto. In this configuration, passage of fluid through the housing is restricted by the seal formed between the sleeve 212 and the cap 218*b* or seal 217, and also by the sealing of the peripheral annulus 222, due to an altered external circumference of the sleeve 212 which functions to seal the peripheral annulus 222 against an internal wall within the housing 202 when the sleeve 212 is at a lower end of its first range. Sealing elements 223 such as O-rings or molded seals, may also facilitate and/or maintain the sealing of the peripheral annulus 222. The sealing elements 223 may be of any type known in the art.

In one embodiment, the plug 214 comprises a relatively narrow lower end 213 which, in combination with a relatively narrow opening in a pressure ring 230 disposed within the housing 102, will function as a differential pressure regulator. The upward forces on the plug 214 can thus be controlled, advantageously resulting in a decreased upward pressure on the plug 214, which will allow for the use of a wide variety of pumps selected from those available to the operator.

Control of upward pressure by the differential pressure regulator advantageously permits the lowering of the pressure differential across the interface of plug 214 and pressure ring 230, thereby requiring less pressure from above to overcome the differential pressure than would normally be required without the differential pressure regulator.

Various aspects of the differential pressure regulator may be selected to limit the upward pressure on the plug 214. These aspects may include the diameter of the various openings, and the configuration of the surface area of the plug 214, among others. In one embodiment, the opening in the pressure ring 230 and/or diameter of a lower portion of the plug 213 will be approximately 50% of the diameter of the downhole tool. This diameter may vary in a range of 10% to 90% of the diameter of the downhole tool, and more preferably will be in a range of 30% to 70% of the diameter of the downhole tool. The surface configuration of the plug 214 along the region that will interface with the pressure ring 230 may also be selected to provide a desired interaction with the pressure ring 230 and/or an opening thereof, thereby further regulating the effect of the downhole pressure on the pressure ring 230.

Figure 2:
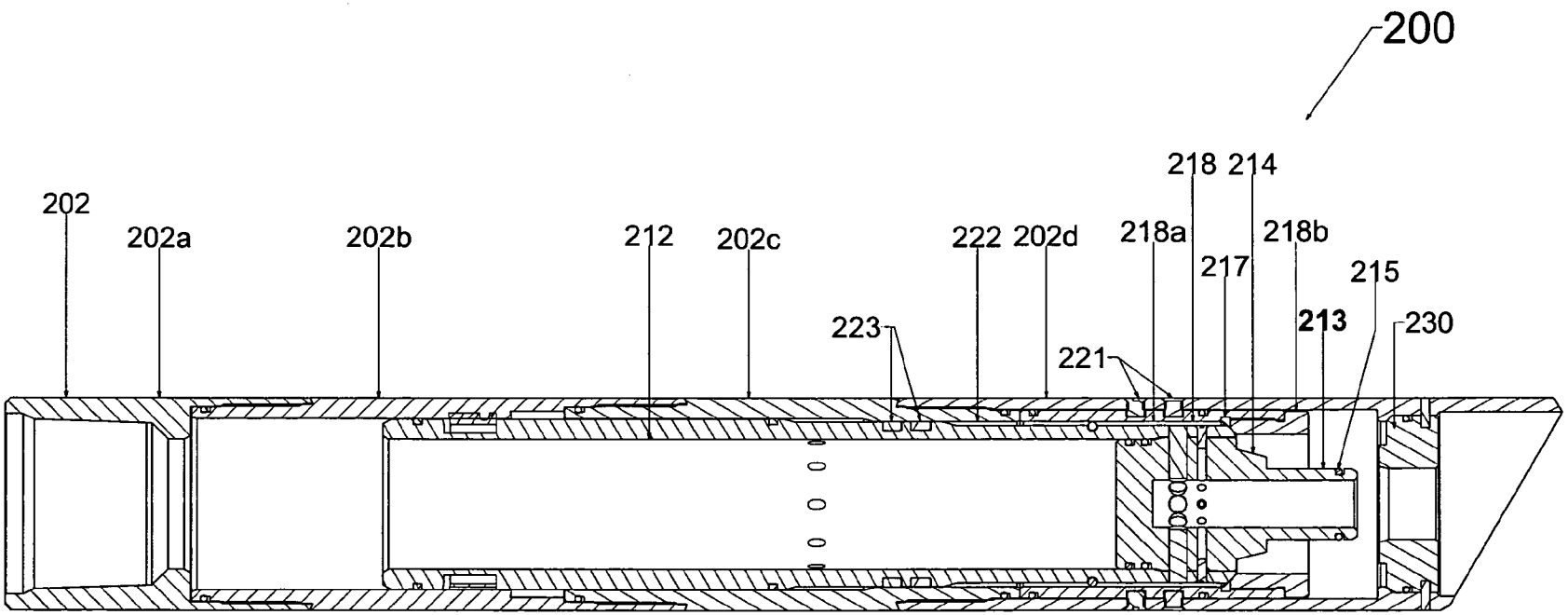
FIG. 2 shows one embodiment of the invention in a repetitive testing configuration.

The running configuration of FIG. 2 permits the testing of the tubing and/or other elements of the tubing string located above the tool 200 in the wellbore. Such testing may be performed by increasing and/or holding pressure in the tubing and evaluating whether the tubing and/or other elements of the string are able to hold pressure. An inability to maintain pressure in the tubing is often indicative of a lack of integrity of the tubing, the joints, and/or other elements of the string.

If a lack of integrity is indicated by the testing, the operator may bleed off remaining pressure in the tubing and then pull the tool 200 to a second testing depth within the wellbore, where pressure may once again be increased and an evaluation of the tubing initiating. In such a fashion, the tool 200 may be advantageously used to localize defects in the tubing string.

If integrity is confirmed by the testing at a selected test depth, additional tubulars may be added to increase the length of the tubing string, and the tool 200 run to a second test depth at which point pressure in the tubing is again increased, and string integrity is again tested. This operation may be repeated until a predetermined final depth is reached.

After reaching the final test depth, pressure in the tubing may be increased beyond a first threshold, to a pressure beyond the range utilized in preceding tests. This pressure range may encompass one or more pressures required to set one or more packers disposed within the wellbore. String integrity may thus be tested at increased pressures until a pressure is reached that is sufficient to displace the lower retention assembly 218 from its first position to a second, lower position, within the housing 202. This will typically occur due to the release or failure of seat retention elements 221 which operatively connect the seat 218*a* of the lower retention assembly 218 to the housing 202. The seat retention element(s) 221 will typically be configured to release or fail at a pressure above that of the initial testing range.

Figure 3:
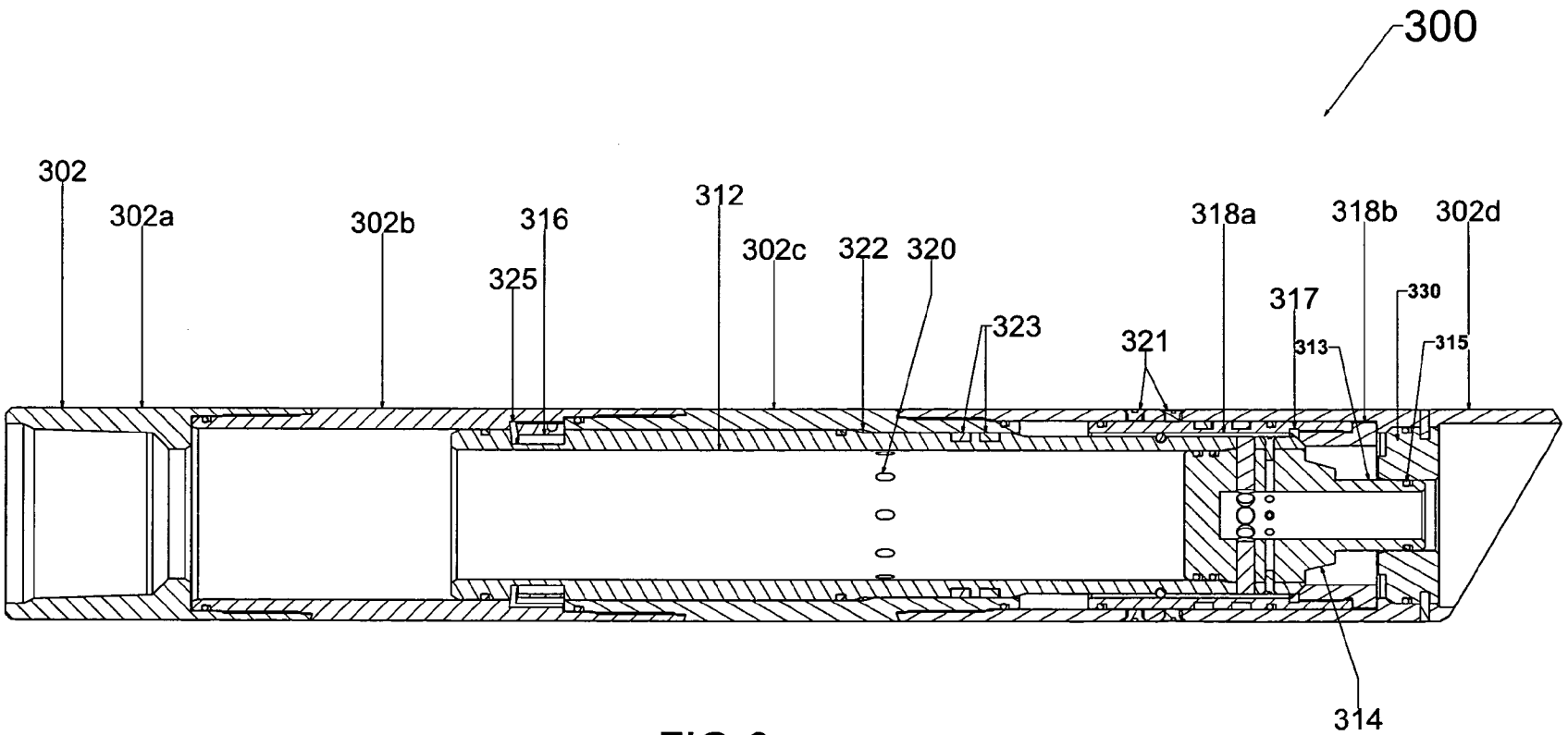
FIG. 3 shows one embodiment of the invention in a final testing configuration.

As shown in the embodiment of FIG. 3, the tool 300 is now in a plugging configuration. The plug 314 has engaged the cap 318*b* of the lower retention assembly 318 (or an operatively connected seal 317 thereof), and increasing pressure on the plug 314 from above presses the plug 314 into the lower retention assembly 318. Once a sufficient pressure is reached to release the seat retention element 321, the lower retention assembly 318, plug 314, and operatively-connected sleeve 312 are downwardly displaced and the sleeve locking element 316 comes into alignment with a recess 325, at which point the sleeve locking element 316 engages the recess 325, locking the sleeve 312 in place and preventing further movement of the sleeve 312 within the housing 302. In one embodiment, the plug 314 and/or an O-ring or similar sealing element 315 operatively connected to the plug 314 will interface with an inner surface of an opening in the pressure ring 330 resulting in a redundant sealing configuration.

With the sleeve 312 locked in place via the sleeve locking element 316, the tool 300 functions as a positive plug, holding pressure from both above and below. The plug 314 and/or sealing element 315 is locked against the cap 318*b* and/or pressure ring 330, the sleeve 312 is locked in a position in which the openings 320 thereof are sealed, or open into a peripheral annulus 322 which is itself sealed due to a widened section of the sleeve 312 contacting an internal surface of the housing 302 and/or sealing elements 323 such as O-rings or molded seals 323. The positive plugging configuration provides a number of additional advantages, including but not limited to, the ability to test the tubing string at higher pressures than previously utilized, the ability to test the annulus, and, because pressure is held from below, the tool 300 may also function as a safety device during the disassembly of the BOP and assembly of the wellhead or Christmas tree at the top of the well.

Figure 4:
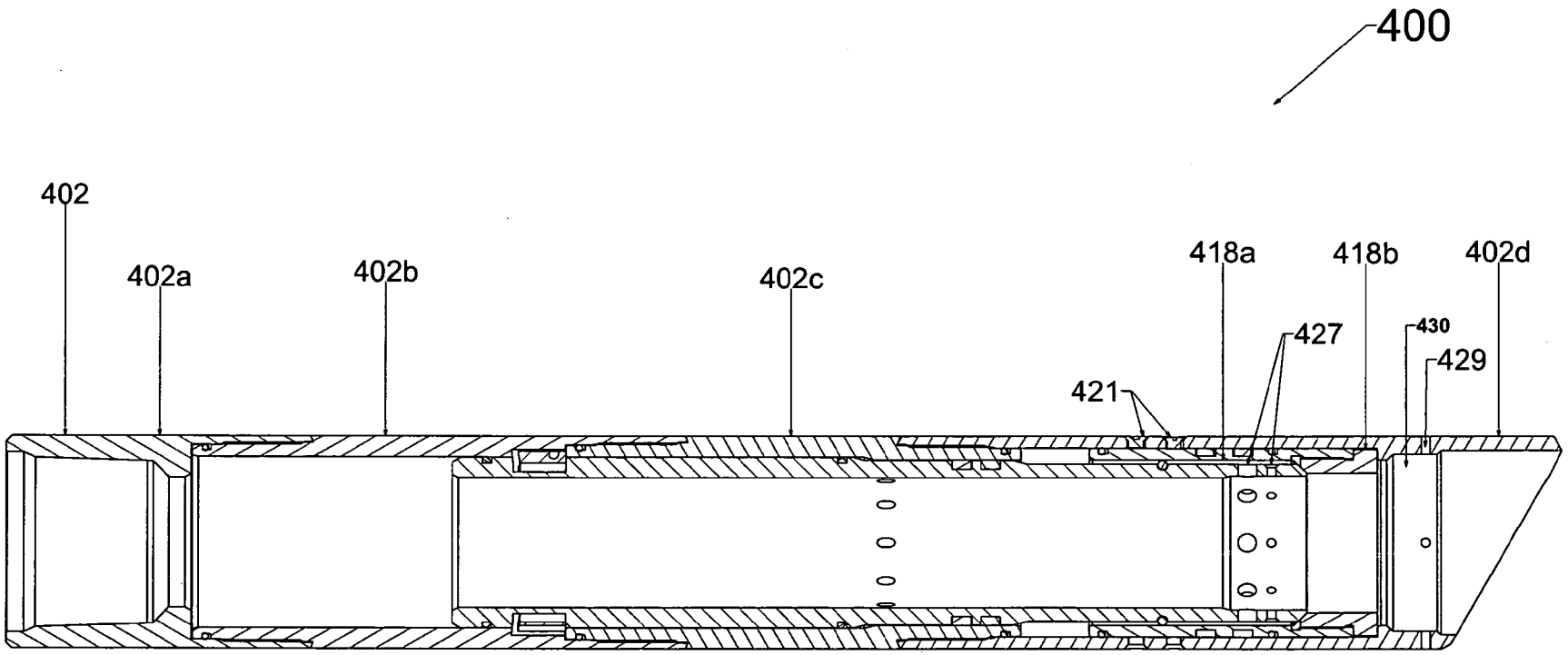
FIG. 4 shows one embodiment of the invention in a production configuration.

Once the Christmas tree is assembled, it is typically desirable to begin production. Accordingly, as shown in the embodiment of FIG. 4, the tool 400 will be placed in a production configuration. To reach a production configuration, additional pressure is applied within the tubing, beyond the pressure range utilized to release the operative connection of the seat retention element(s) 421, and sufficient to cause a release of the plug retention element(s) 427 and pressure ring retention elements 429. Typically, the release of these retention elements occurs as a result of increased pressure within the tubing pressing the plug 414 against the pressure ring 430 with sufficient force to release the retention elements 427, 429. This increased pressure will typically be in a range greater than any pressure range previously applied to achieve testing and/or positive plugging configurations of the tool 400. This increased pressure range may encompass one or more pressures required to set one or more packers within the wellbore.

Upon release of the plug retention element(s) 427 and pressure ring retention element(s) 429, the plug 414 and pressure ring 430 will fall out of the tool 400 and into the bottom of the wellbore (i.e., the rat-hole). The seat 418*a* and cap 418*b* are prevented from further downward movement by an internal configuration of the housing 402. The tool 400 is now in a production configuration, with an internal passage that is in fluid communication with the tubing above, and wellbore below, and preferably having a diameter no greater than that of any other element of the tubing string, thereby advantageously permitting a relatively unrestricted flow of hydrocarbons through the tool 400.

Figure 5:
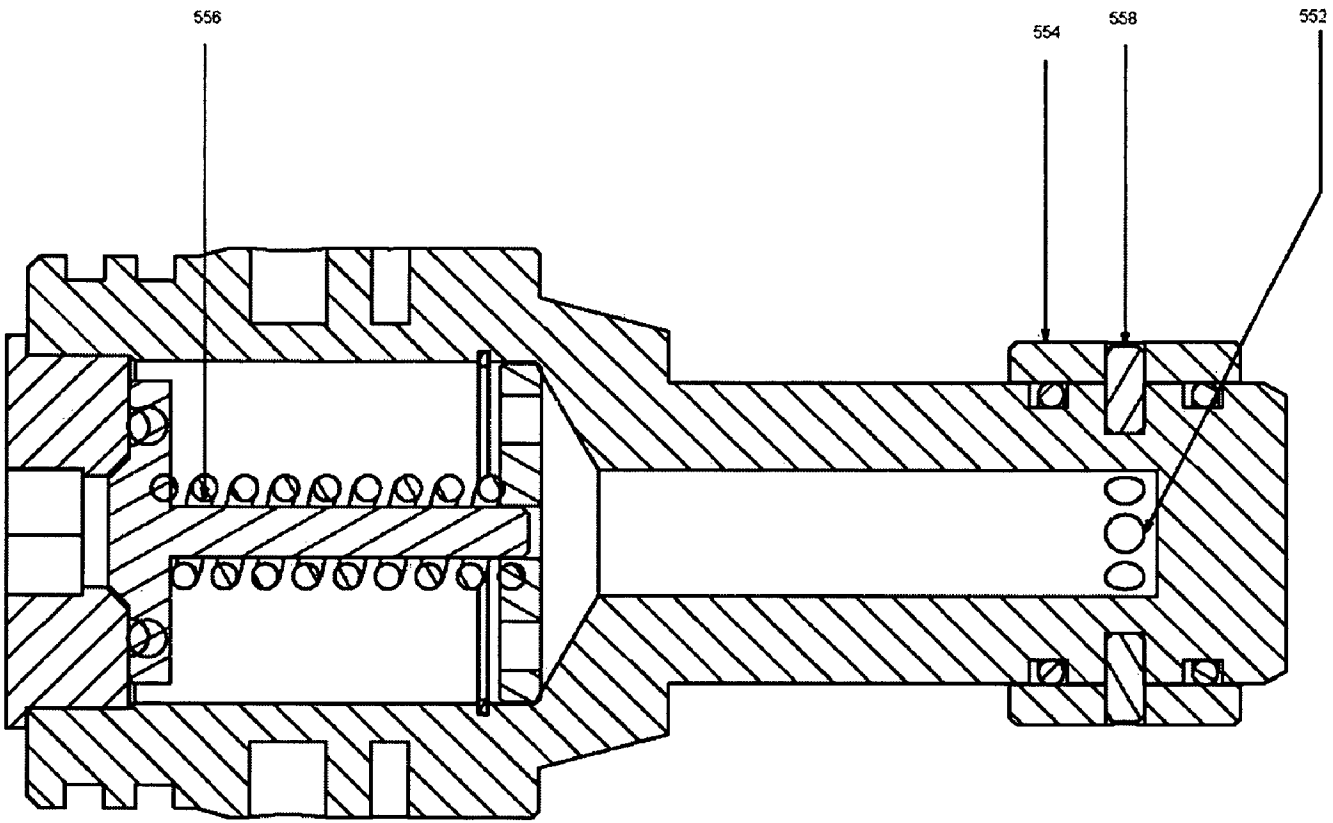
FIG. 5 shows a positive plug indicator according to one embodiment of the invention.

As shown in FIG. 5, in one embodiment, the downhole tool 500 further comprises an indicator assembly 550. The indicator assembly 550 is configured to provide confirmation that the downhole tool 500 is in a positive plugging configuration. Typically, such confirmation is indicated by a drop in pressure within the tubing that is detectible at a surface location. The indicator assembly 550 comprises various modifications to selected elements previously described herein. In particular, one or more holes 552 are disposed in a lower section of the plug 513, a collar 554 is disposed along a circumference of the plug 514, in substantial alignment with the hole(s) 552, and a check valve 556 is operatively connected to the plug 514, and may be disposed therein, or alternatively may be disposed in the operatively connected sleeve 512. The collar 554 is operatively connected to the plug 514 using at least one retention element 558. As pressure is increased within the tubing to a pressure sufficient to move the plug 514 into the pressure ring 530, the collar 554 contacts an upper lip of the pressure ring 530 surrounding the opening in the pressure ring 530, and is displaced thereby, due to release of the retention element(s) 558. The places the holes 552 of the plug 514 in fluid communication with the wellbore beneath the tool 500. In such a configuration, the check valve 556 restricts the passage of fluid in one direction, but allows at least some fluid to pass in a second direction, at least when a sufficient pressure is exerted on the fluid.

The check valve 556 is typically configured to permit passage of fluid from within the tool 500 to a location below the tool 500 in the wellbore, but restricts passage of fluid from beneath the tool 500 into the operatively connected tubing above the tool 500. The check valve 556 may be of any type known in the art. The drop in fluid pressure within the tubing, once the hole(s) 552 of the plug are exposed due to displacement of the collar 554 by the pressure ring 530, is due to the passage of pressurized fluid from the tubing above the tool 500 into the wellbore beneath the tool 500. This pressure drop is easily detectible at the surface, and will confirm that the tool 500 is now in a configuration capable of holding pressure from below.

In various embodiment, the tool may be configured to operate in only selected configurations selected from those previously described. For example, in one embodiment, the tool is configured to transition from a running configuration, capable of self-filling the tubing operatively connected above, to a positive plug, capable of holding pressure in the tubing both above and below the tool.

In one embodiment, the tool is configured to transition from a running self-filling configuration, to a positive plug, to a production configuration. In one embodiment, the tool is configured to transition between a running and a testing configuration, for repeated testing operations, and then to a positive plug. In one embodiment, the tool is configured to transition between a running and a testing configuration, for repeated testing operations, then to a positive plug, and finally to a testing configuration.

Embodiments of the downhole tool disclosed herein may be used at various pressure ranges and the retention elements may vary in type, configuration, quantity, and other characteristics as required to render the embodiments operative in the manner described at selected pressures or pressure ranges. One embodiment of the downhole tool may be configured to operate at pressure ranges up to 10,000 psi. More preferably, embodiments of the invention will be configured to operate at pressure ranges up to 5,000 psi, a range which is typically sufficient for most wellbore applications.

Release pressures (or pressure ranges) will typically be selected within the operating pressure range based on a number of factors. Such factors may include the predicted operating pressure within the wellbore, tubing/joint tolerances, and sufficient differentiation to ensure that desired operations may be performed between a first and second release pressure, without inadvertent release of additional retention elements.

The various components of embodiments of the tool described herein may be formed of any material or combination of materials known in the art. Furthermore, dimensions of the various components may vary from those depicted in the figures. Typically, embodiments configured to operate at higher pressure ranges will comprise more robust materials and have an increased wall thickness.

In one embodiment, representative release pressures of the retention elements which retain the shear seat may be 1300 psi, 1500 psi, 2000 psi, 2300 psi, and 2600 psi, respectively, which will typically correspond to a selected number of retention elements (e.g., shear pins). In such an embodiment, the number of shear pins correlating to the release pressures may be 4, 5, 6, 7, or 8 shear pins, respectively, to attain the selected release pressures, depending on the configuration of each shear pin. Similarly, in one embodiment, the plug retention elements may release at 2250 psi, 2850 psi, and 3500 psi, respectively. Again, these representative release pressures may correspond to the use of selected numbers of retention elements, such as 3, 4, or 5 retention elements, respectively, for the stated release pressures. As previously discussed, typical release values for the plug will typically be higher than those for the shear seat.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A downhole tool, comprising:

a housing;

a sleeve moveably disposed within the housing and comprising at least one opening in a sidewall thereof;

a peripheral annulus at least partially disposed between the sleeve and the housing;

a plug operatively connected to the sleeve by at least one plug retention element;

a lower retention assembly disposed beneath the sleeve within the housing, and comprising a seat and a cap, wherein at least one seat retention element operatively connects the seat to the housing; and a pressure ring operatively connected to the housing below the cap.

2. The downhole tool of claim 1, wherein the peripheral annulus is configured to be in fluid communication with both an interior of the sleeve and a space below the tool when the sleeve is in a first position.

3. The downhole tool of claim 2, further comprising at least one seal disposed between the sleeve and the housing.

4. The downhole tool of claim 1, further comprising:

a sleeve locking element operatively connected to a first one selected from an inner surface of the housing and an outer surface of the sleeve, and configured to cause minimal interference with movement of the sleeve within a first range of movement of the sleeve; and a mating element configured to operatively connect with the sleeve locking element and formed in a second one selected from the inner surface of the housing and the outer surface of the sleeve.

5. The downhole tool of claim 4, further comprising an indicator assembly.

6. The downhole tool of claim 1, wherein the housing comprises a plurality of operatively-connected sub-housings.

7. The downhole tool of claim 1, wherein an upper end of the housing is configured to connect to a component of a tubing string, and a lower end of the housing is configured as a wireline re-entry guide.

8. The downhole tool of claim 1, wherein the at least one seat retention element is selected to release at a pressure that is lower than a release pressure of at least one selected from (a) at least one pressure ring retention element, and (b) the at least one plug retention element.

9. The downhole tool of claim 8, wherein the at least one plug retention element is selected to release at a pressure that is lower than a release pressure of the at least one pressure ring retention element.

10. The downhole tool of claim 1, wherein the plug has a relatively narrow end configured to substantially occlude a relatively narrow opening in the pressure ring.

11. The downhole tool of claim 10, wherein the relatively narrow end of the plug and relatively narrow opening in the pressure ring, each comprise a diameter that is less than 50% of the diameter of the housing, thereby permitting a differential pressure regulation of a downhole upward pressure in relation to a surface pressure.

12. The downhole tool of claim 1, further comprising a seal operatively connected to an upper surface of the cap and configured to form a seal with a lower surface of the sleeve, when the sleeve is in proximity to the cap.

13. A method for testing a tubing string, comprising the following steps in sequence:

(a) providing a testing tool comprising a sleeve moveably disposed within a housing, a plug operatively connected to the sleeve within the housing, a peripheral annulus disposed between the housing and the sleeve, a lower retention assembly disposed beneath the sleeve within the housing, and a pressure ring disposed beneath the lower retention assembly;

(b) operatively connecting the testing tool to a tubing component;

(c) lowering the testing tool to a first test depth within a wellbore;

(d) applying a first pressure within the tubing string, sufficient to cause the testing tool to enter a testing configuration;

(e) evaluating the tubing string at the first pressure;

(f) moving the testing tool to a second test depth within the wellbore; and (g) repeating steps (d)-(f) until the occurrence of one selected from (1) the detection of a defect in the tubing string, and (2) the reaching of a desired depth for termination of testing.

14. The method of claim 13, further comprising applying a second pressure within the tubing string, said pressure being greater than the first pressure, and sufficient to release a seat retention element disposed within the testing tool, causing the testing tool to enter a plugging configuration.

15. The method of claim 14, wherein the second pressure is one sufficient to set at least one packer disposed above the tool in the wellbore.

16. The method of claim 14, further comprising applying a third pressure within the tubing string, said third pressure being greater than the second pressure, and sufficient to release a plug retention element disposed within the housing, causing the tool to enter a production configuration.

17. A method for manufacturing a downhole tool, comprising:

providing a housing;

providing a sleeve with at least one opening formed in a wall thereof;

operatively connecting a plug to one end of the sleeve using at least one plug retention element providing a lower retention assembly comprising a cap operatively connected to a seat;

disposing the sleeve within the housing, below an upper sleeve retention element, and oriented with the operatively connected plug at an opposite end from that nearest the upper sleeve retention element; and operatively connecting the lower retention assembly to the housing beneath the sleeve using at least one seat retention element.

18. The method of claim 17, further comprising operatively connecting a sleeve locking element to the sleeve prior to disposing the sleeve within the housing.

19. The method of claim 17, further comprising forming a peripheral annulus within the housing prior to disposing the sleeve within the housing.

20. The method of claim 17, wherein the housing comprises a plurality of sub-housings.

* * * * *